US006413580B1

(12) United States Patent
Haas et al.

(10) Patent No.: US 6,413,580 B1
(45) Date of Patent: Jul. 2, 2002

(54) METHOD AND DEVICE FOR APPLYING POWDER ON MOBILE SECTIONS OF PRINTING SHEETS

(75) Inventors: Reiner Haas, Metzingen; Günther Hess, Reutlingen, both of (DE)

(73) Assignee: Weitmann & Konrad GmbH & Co., KG, Leinfelden-Echterdingen (DE)

( * ) Notice: Subject to any disclaimer, the term of this patent is extended or adjusted under 35 U.S.C. 154(b) by 0 days.

(21) Appl. No.: 09/554,756

(22) PCT Filed: Sep. 25, 1998

(86) PCT No.: PCT/EP98/06120

§ 371 (c)(1),
(2), (4) Date: Jul. 13, 2000

(87) PCT Pub. No.: WO99/26786

PCT Pub. Date: Jun. 3, 1999

(30) Foreign Application Priority Data

Nov. 20, 1997 (DE) ..... 197 51 383

(51) Int. Cl.[7] ..... B05D 1/112

(52) U.S. Cl. ..... 427/180; 427/202; 427/475; 427/421; 118/308; 118/DIG. 1; 101/424.2

(58) Field of Search ..... 427/180, 202, 427/475, 477, 482, 485, 421, 426; 118/300, 308, DIG. 1; 239/290, 291, 296; 101/424.2, 492

(56) References Cited

U.S. PATENT DOCUMENTS

| | | | | |
|---|---|---|---|---|
| 2,110,052 A | | | 3/1938 | Wilmette, III |
| 3,589,607 A | | * | 6/1971 | Wolf et al. |
| 3,635,401 A | | * | 1/1972 | Bromley et al. |
| 4,024,815 A | | * | 5/1977 | Platsch |
| 4,106,697 A | | * | 8/1978 | Sickles et al. |
| 4,124,875 A | | * | 11/1978 | Van Zantwyke |
| 5,001,980 A | | | 3/1991 | Aoki et al. |
| 5,443,005 A | | * | 8/1995 | Platsch |
| 5,486,676 A | | * | 1/1996 | Aleshin |
| 5,980,994 A | | * | 11/1999 | Honma et al. |

FOREIGN PATENT DOCUMENTS

| | | | |
|---|---|---|---|
| DE | 2110052 | * | 3/1938 |
| DE | 1252703 | | 10/1967 |
| DE | A1-2519831 | | 11/1976 |
| DE | A1-3826331 | | 2/1990 |
| DE | 2207983 | | 8/1993 |
| DE | A1-19614193 | | 10/1997 |
| DE | A1-19625099 | | 1/1998 |
| GB | 1094898 | | 12/1967 |

OTHER PUBLICATIONS

Patent Abstract of Japan, vol. 11, No. 266, 62–68754, Aug. 28, 1987.

* cited by examiner

*Primary Examiner*—Fred J. Parker
(74) *Attorney, Agent, or Firm*—Birch, Stewart, Kolasch & Birch

(57) ABSTRACT

The invention concerns a method and a device for applying powder on sections of printing sheets (2). The invention includes a powder airflow (8) enclosed in a protective airflow (13) such that the powder airflow is steady and protected against the action of possible disturbances until it reaches the sections of printing sheets (2).

13 Claims, 3 Drawing Sheets

METHOD AND DEVICE FOR APPLYING POWDER ON MOBILE SECTIONS OF PRINTING SHEETS

This application is the national phase under 35 U.S.C. §371 of PCT International Application No. PCT/EP98/06120 which has an International filing date of Sep.25, 1998, which designated the United States of America.

BACKGROUND OF THE INVENTION

1. Field of the Invention

The invention involves a process for applying powder on a moving printed sheet, where powder is added into an airflow directed at the printed sheet, so that this powder is transported by the airflow to the printed sheet. The invention also involves a device for applying powder to the moving printed sheet using a first nozzle for discharging an airflow loaded with powder, which is directed at the printed sheet.

2. Related Art

A device of this type is disclosed, for example, in German patent document DE-AS 12 52 703. In that patent, several nozzle base structures are attached to a girder beam. These nozzle base structures discharge, in a fan-like manner a carrier airflow, into which an airflow loaded with powder is supplied. This is necessary since printing ink is still moist on the individual printed sheets when the printed sheets are stacked, and therefore, the printed sheets must be kept at a distance from each other using the powder. Because a spacing of individual nozzle base structures is relatively large because of a move-by gripper that grasps the printed sheet, normally between 50 to 150 mm, the carrier airflow must be adjusted in such a manner that the powder is transported with certainty to the printed sheet. Because the gripper speed is approximately 4 m/s at a printing output of 18,000 sheets per hour, relatively high cross-currents are predominant, which negatively impair the carrier airflow and thus the powder application. For example, the carrier airflow may not, under certain circumstances, spread out vertically downward as desired and thus may fail to deposit the powder as intended on the printed sheet. Thus, the carrier airflow is adjusted in such a manner that it has a relatively high air impulse current, which lies in the area of 0.04 N. In addition, the individual nozzles are arranged in such a way on each nozzle base structure that several carrier airflows of a nozzle base structure form a fan-like jet, where the individual carrier airflows relatively rapidly become unified after exiting from the nozzles into this fan-like jet. The nozzle base structures are arranged in such a way that the fan-like jets overlap each other. Therefore, the printed sheet should be relatively uniformly dusted with powder. However, it is considered disadvantageous to have fan-like jets of this type, which are relatively susceptible to cross-currents, and to have a printed sheet, which is impinged with a relatively large air impulse current. This leads to a disadvantageous effect on paper flow of the printed sheet.

SUMMARY OF THE INVENTION

It is thus an object of this invention to provide a process and/or a device, with which the printed sheet can be optimally dusted, the loss of powder is reduced and the printed sheet is impinged with a lower air impulse current.

This purpose is achieved according to the invention in a process of the type set forth at the beginning hereof, in that the airflow that carries the powder is surrounded by a powderless supporting airflow that at least partially envelops it.

A process according the invention thus provides that in addition to the airflow, which is loaded with powder, an additional airflow, namely a supporting airflow, is generated, which at least partially surrounds the powder airflow and supports and protects it in the direction to the printed sheet. The supporting airflow forms a sheath or a protective envelope around the powder airflow, so that it stays bundled on the one hand over a longer section, and on the other hand, possibly prevalent cross-currents do not act directly on the powder airflow, but instead first contact the supporting airflow. By enveloping the powder airflow with powderless air, interactions of the powder airflow with surrounding air are prevented or at least considerably reduced. Possible interfering air only entrains powderless air out of the supporting airflow, thereby ensuring no powder loss occurs.

An additional advantage is seen in that by enveloping the powder airflow, the powder airflow retains its form for a considerably longer period, so that a smaller air impulse current is necessary in order to transport the powder to the printed sheet. It has shown that in the process according to the invention, an air impulse current is required in the range from 0.01 to 0.02 N. This, however also leads to the fact that the paper flow is improved, since the printed sheet is much less loaded.

An additional embodiment provides that the supporting airflow is formed from several air jets. Instead of one ring-shaped supporting airflow, the airflow can also be formed from several, e.g. from four individual airflows, which unite immediately after exiting from additional nozzles into an enveloping jet or into several partial enveloping jets.

Advantageously, the powder airflow is supported on sides of the supporting airflow that are orthogonal to the transport direction of the printed sheet. This is advantageous because the powder airflow is protected by the supporting airflow, so that cross currents caused by the gripper only have a relatively small effect on the powder airflow.

Advantageously, the powder airflow is a discrete omnidirectional jet, as such is better suited for the transport of the powder to the printed sheet. In addition, omnidirectional jets are less susceptible to cross currents than fan jets.

The purpose of the present invention discussed heretofore is achieved using a device according to the invention in that along with a first nozzle for discharging the powder airflow, at least one additional nozzle is provided for discharging a powderless supporting airflow that at least partially envelops the powder airflow.

Thus with the device according to the present invention, two airflows are discharged which are different from each other. Via the one airflow, the powder airflow, the powder is transported to the printed sheet. The other airflow is powderless and has the functionality of supporting and protecting the powder airflow. The supporting of the powder airflow allows the airflow to retain its form over a wide range. The protective function is seen in that possible interferences through cross currents do not directly act on the powder airflow and entrain the powder, but instead possibly act on the supporting airflow, which is powderless.

In one embodiment, it is provided that to every first nozzle, four other nozzles are allocated. These four other nozzles form four partial airflows, which relatively quickly unify after they are let out of the other nozzles into the supporting airflow. Advantageously, the supporting airflow has the same flow speed as the powder airflow, so that the two currents can be fed onto each other without interference and essentially will not mix.

In order to be able to optimally oppose cross currents, the additional nozzles are arranged on the nozzle base structure essentially perpendicular to the transport direction of the printed sheet. In this manner, the powder airflow is more or less protected through an especially two-sided protected curtain.

According to the invention, the first nozzle powder airflow is constructed such that the powder airflow is a circular section jet. Circular section jets have, as already mentioned, the considerable advantage that they are relatively less susceptible to interference because of their smaller surface area and that they transport the powder optimally in the desired direction.

According to the invention, the first nozzle is constructed so that it is relatively long, so that the circular section jet can be shaped in the nozzle and keeps its shape for a relatively long time, even without the protective airflow.

Advantageously, the cross section of the first nozzle is substantially larger than the second nozzle. Since the protective airflow is not needed for the transport of the powder, but instead only in order to support and protect against interference effects, it can be constructed as a relatively thin envelope. This also has the advantage that the air impulse current, as already mentioned above, is reduced, and by this the paper flow of the printed sheet is improved. In addition, the powder airflow can, because of the protecting envelope, be supplied to the printed sheet with a smaller impulse current, where the air impulse current of the protecting current is as a rule even smaller than the powder airflow.

In one embodiment it is provided that the nozzle base structure has two first nozzles and four other nozzles allocated to each of the first nozzles. Nozzle structures with three first nozzles are also conceivable. Regardless, it is not necessary to provide nozzle structures with a plurality of nozzles in order to ensure a fan-like discharge of the powder. It is sufficient to provide two or three first nozzles, by which the powder is discharged into the powder airflow.

A special embodiment form of the nozzle structure provides that the nozzles are arranged in at least two, in particular, three planes perpendicular to the transport direction. Therefore, the other nozzles for the supporting airflow are provided in one or two planes and the nozzles for the powder airflow are provided in one plane. In this way, the prerequisite is created that the individual partial airflows form the supporting airflow relatively quickly and the two or three powder airflows, which transport the powder in the direction to the printed sheet for a relatively long time as a circular section jet, become unified with the adjacent powder airflows into a fan-like jet only shortly before the printed sheet surface.

A simple construction of the nozzle base structure is obtained according to the invention in that the nozzle is constructed in a plate-like manner in the area of the nozzle, such that one plate is provided with the first nozzle and other plates are provided with the other nozzles. This platelike construction has the advantage that the nozzle base structure can be put together in a module-like manner, and in this way can be adapted for injection molding technique.

Additional characteristics, advantages and details of the invention can be gathered from the claims as well as from the following description, in which, in reference to the drawings a particularly preferred embodiment is described in detail.

BRIEF DESCRIPTION OF THE DRAWINGS

In the process, the characteristics depicted in the drawings and mentioned in the description and in the claims can each be inventive individually or in any desired combination. Shown in the drawings are:

DETAILED DESCRIPTION OF THE PREFERRED EMBODIMENTS

Figure 1:
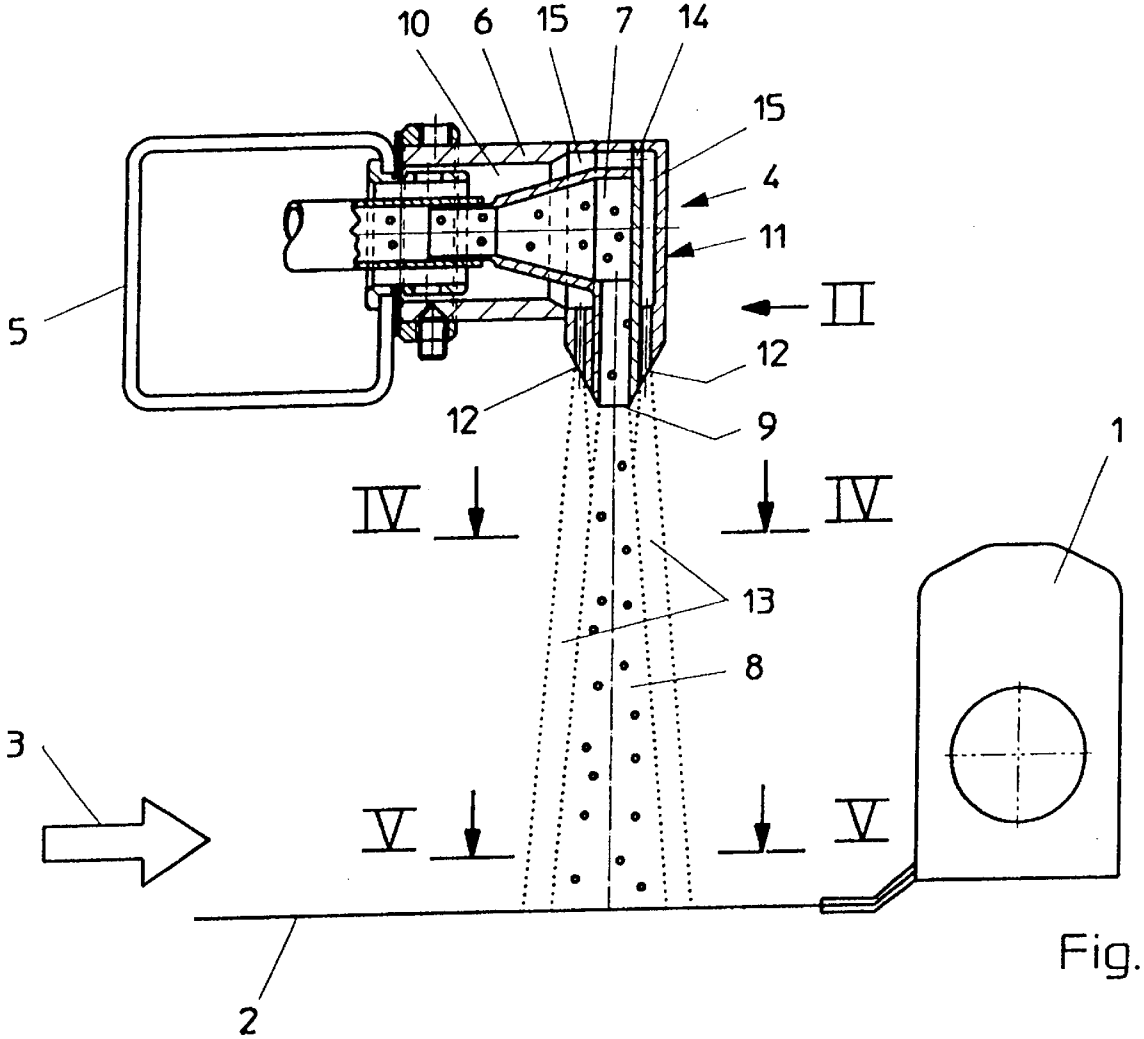
FIG. 1 is a sectional view through a nozzle base structure that is affixed to a beam.

In FIG. 1, a gripper 1 is shown in a suggested form, which transports a printed sheet 2 in the direction of the arrow 3 (transport direction). Above the printed sheet 2 and at a distance from the printed sheet 2, which ensures an unobstructed passing by of the gripper 1, several nozzle base structures 4 are located, of which one is shown. These nozzle base structures 4 are affixed on a beam 5 extending perpendicular to the transport direction 3, and are shiftable in a direction of the beam 5, i.e. perpendicularly to the transport direction 3 and perpendicularly to the plane of the drawing. The nozzle base structure 4 has a housing 6, in which a flow channel 7 is provided for a powder airflow 8 loaded with powder. This flow channel 7 discharges at a first nozzle 9 out of the nozzle base structure 4. The nozzle head 11 of the nozzle base structure 4 is constructed in a sandwich-like manner from several plates, which can be seen clearly in FIG. 1. The flow channel 7 is surrounded by an air channel 10, into which powderless air is supplied. In the nozzle head 11, there are additional nozzles out of which a supporting airflow 13 discharges. These other nozzles 12 are connected to the air channel 10.

Figure 2:
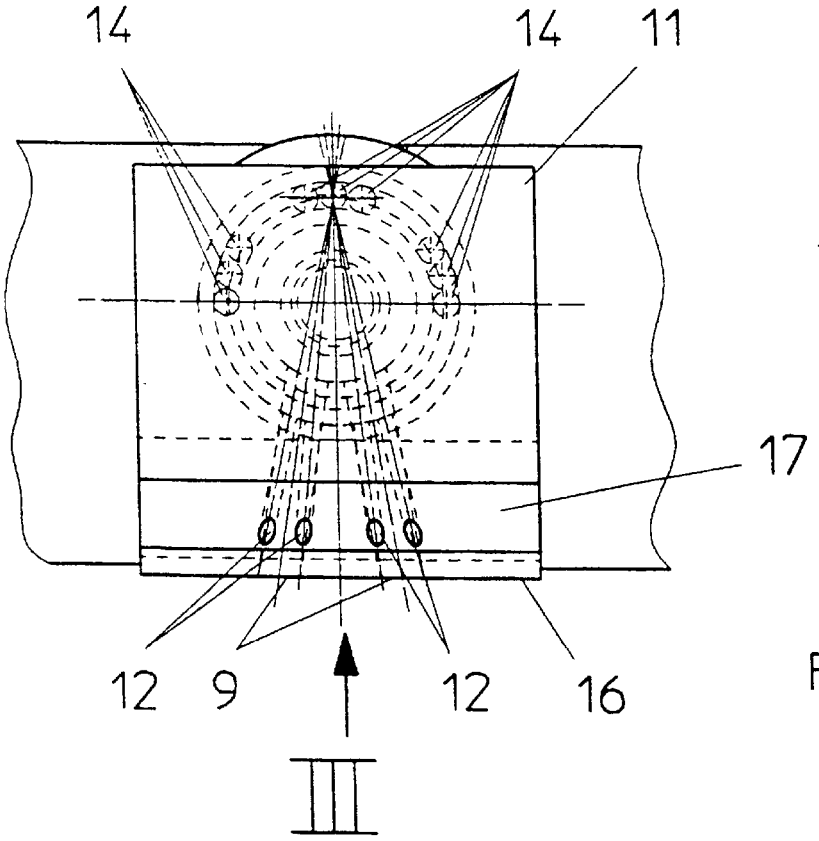
FIG. 2 is a view in the direction of arrow II according to FIG. 1.

From FIG. 2, which shows a front view II, it can be recognized that the air channel 10 is connected via bore holes 14 to ring channels 15, via which the powderless air flows into the other nozzles 12. In addition, in FIGS. 1 and 2 it is shown clearly that on a facing surface 16, the first nozzle discharges and on sloped side surfaces 17, the other nozzles 12 discharge. This has the advantage that the supporting airflow 13 discharges in front of a powder airflow 8 and in this way an envelope can be readily formed, into which the powder airflow 8 is blown.

Figure 3:
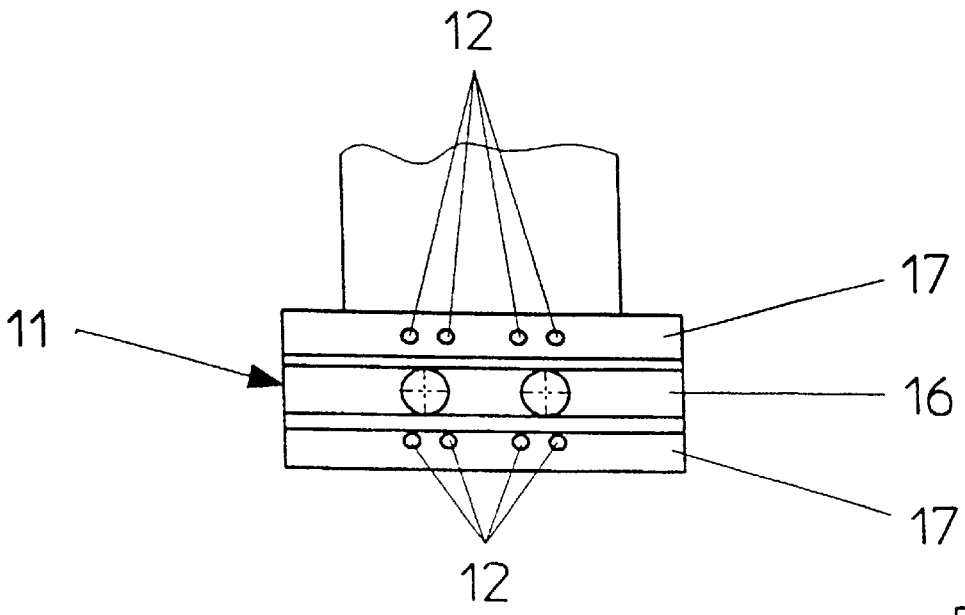
FIG. 3 is a view in the direction of arrow III according to FIG. 2.

From FIGS. 2 and 3, the facing surface 16 and the side surfaces 17 can be clearly recognized and in the embodiment shown, the nozzle head 11 has two first nozzles 9 and four other nozzles 12 allocated to each of the first nozzles 9. In addition, it can be recognized that the cross-section of the first nozzles 9 is considerably larger than the cross-section of the other nozzles 12, so that the powder airflow 8 leaving the first nozzles 9 has a considerably larger volume than the supporting airflow 13 leaving the other nozzles 12.

Figure 4:
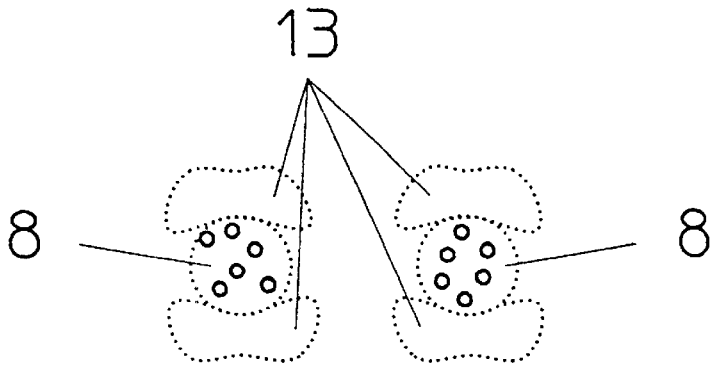
FIG. 4 is a section IV—IV according to FIG. 1.

From FIG. 1 it can also be recognized that the powder airflow 8 is essentially blown out from the first nozzle 9 as a bundled jet in the direction of the printed sheet 2. This is also shown clearly in section IV—IV (FIG. 4), where the powder airflow 8 still forms a circular section jet with the indicated powder. The partial airflows blown out of the other nozzles 12, which have a considerably smaller volume have already become partially unified and form the supporting airflow 13 that flanks the powder airflow 8. This supporting airflow 13 must not necessarily completely surround the powder airflow 8. It is sufficient when the supporting airflow 13 protects the powder airflow 8 from interference effects, which are caused by the passing gripper 1. In addition, the two powder airflows 8 can expand to the side, i.e. in the direction towards each other, so that they mix together in the area of the printed sheet surface and hit the printed sheet as continuous, powderloaded strips of air. Not only do the powder airflows 8 expand in the perpendicular direction, but the supporting airflows 13 do as well, so that they gradually form a closed curtain with the powder airflows 8 located in between.

Figure 5:
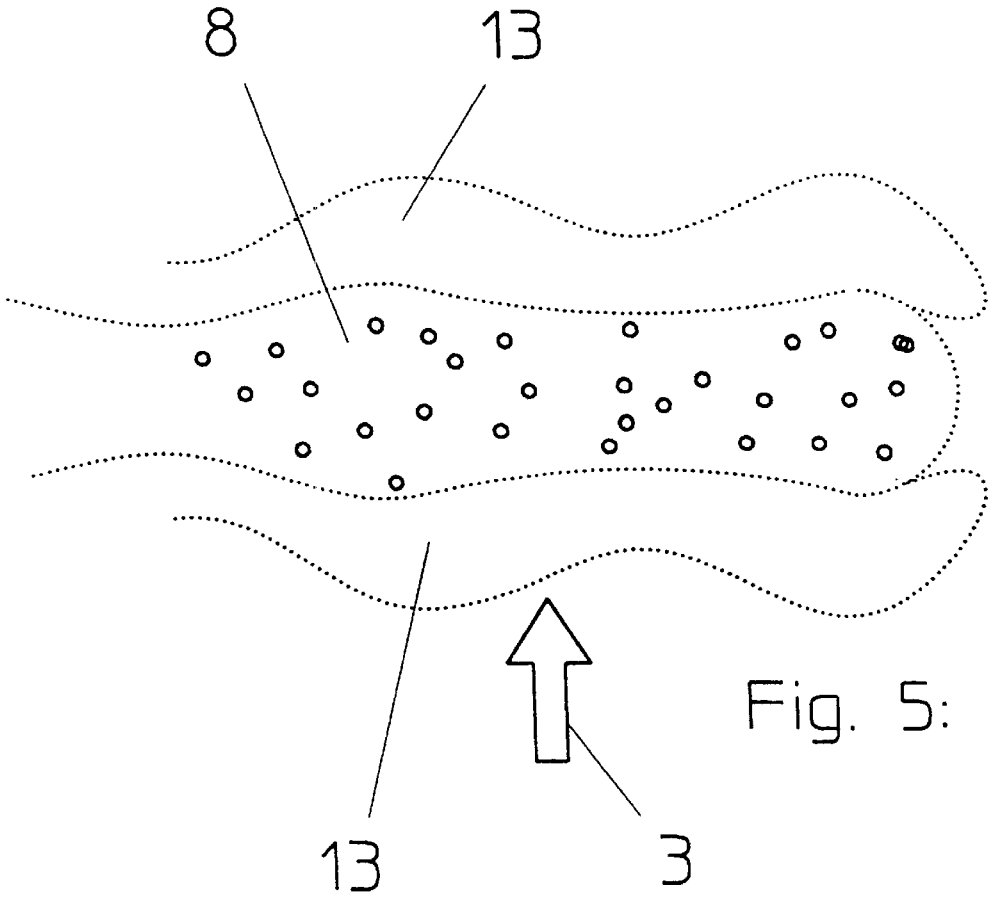
FIG. 5 is a section V—V according to FIG. 1.

From the section V—V shown in FIG. 5, it can be recognized clearly that the powder airflow 8 is flanked on both sides by the supporting airflow 13. This supporting airflow 13 thus supports the powder airflow 8 from the nozzle 9 to the point of striking the printed sheet 2 and holds the powder airflow bundled in the transport direction 3. In addition, in case of an interference, only air portions out of the supporting airflow 13, but not out of the powder airflow 8, are torn away. Since the individual powder airflows 8 first fuse shortly before the striking on the printed sheet 2 and until then, are discrete circular section jets, they can be protected in an easier manner from the surroundings, such that on the one hand, less additional air is needed, and on the other hand, this air has a smaller air impulse current.

What is claimed is:

1. A process for applying powder on a moving printed sheet (2), comprising the steps of:

adding powder to an airflow (8) directed at the printed sheet (2), whereby the powder is transported by the airflow (8) to the printed sheet (2), and wherein the powder airflow (8) that carries the powder is at least partially surrounded along a length of the powder airflow before the powder airflow strikes the printed sheet, by a powderless supporting airflow (13) directed substantially parallel to, and being immediately flanking, the powder airflow so as to touch the powder airflow (8) along the length thereof, before the powder airflow strikes the printed sheet, for supporting and protecting the powder airflow (8).

2. The process according to claim 1, wherein the supporting airflow (13) is formed from a plurality of air jets.

3. The process according to claim 1, wherein the powder airflow (8) is supported by the supporting airflow (13) on the sides that are orthogonal to a transport direction (3) of the printed sheet (2).

4. The process according to claim 1, wherein the powder airflow (8) is a discrete circular section jet.

5. A device for applying powder on a moving printed sheet (2), comprising:

a first nozzle (9) for discharging an airflow (8) loaded with powder, which is directed at the printed sheet (2), and at least one additional nozzle (12) arranged substantially parallel to the first nozzle is provided for discharging a powderless supporting airflow (13) substantially parallel to the powder airflow that at least partially envelops, is substantially parallel to, and touches the powder airflow (8), along a length of the powder airflow before the powder airflow strikes the printed sheet, for supporting and protecting the powder airflow (8) directed at the printed sheet (2).

6. The device according to claim 5, wherein four additional nozzles (12) are provided for discharging the powderless supporting airflow.

7. The device according to claim 6, wherein the additional nozzles (12) are essentially arranged perpendicularly to a transport direction (3) of the printed sheet (2).

8. The device according to claim 5, wherein the first nozzle (9) for the powder airflow (8) is constructed so that the powder airflow (8) is a circular section jet.

9. The device according to claim 5, wherein a cross section of the first nozzle (9) is larger than that of the at least one additional nozzle (12).

10. The device according to claim 6, wherein the nozzles (9,12) are housed in a nozzle base structure (4).

11. The device according to claim 5, wherein the nozzles (9, 12) are arranged in three planes perpendicular to a transport direction (3) of the printed sheet (2).

12. The device according to claim 10, wherein the nozzle base structure (4) is constructed from a plurality of plates, the plurality of plates defining the nozzles (9,12).

13. The device according to claim 10, wherein the nozzle base structure (4) including the nozzles (9, 12) is essentially constructed prismatically and has a facing surface (16) that is essentially parallel to the printed sheet (2) and has two side surfaces (17) sloped away from the facing surface (16), and the first nozzle (9) is provided in the facing surface (16) and the at least one additional nozzle, being at least two additional nozzles (12), are provided in the side surfaces (17).

* * * * *